US006292747B1

(12) United States Patent
Amro et al.

(10) Patent No.: US 6,292,747 B1
(45) Date of Patent: Sep. 18, 2001

(54) HETEROGENEOUS WIRELESS NETWORK FOR TRAVELER INFORMATION

(75) Inventors: Hatim Yousef Amro; George Kraft, IV, both of Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/552,860

(22) Filed: Apr. 20, 2000

(51) Int. Cl.[7] ..... G08G 1/09
(52) U.S. Cl. ..... 701/213; 455/456
(58) Field of Search ..... 701/213; 340/902, 340/903, 991, 992, 993; 455/456, 457, 458

(56) References Cited

U.S. PATENT DOCUMENTS

| | | | | |
|---|---|---|---|---|
| 5,349,520 | * | 9/1994 | Hickman | 364/424.01 |
| 5,428,544 | * | 6/1995 | Shyu | 364/436 |
| 5,432,841 | * | 7/1995 | Rimer | 379/59 |
| 6,028,537 | * | 2/2000 | Suman et al. | 340/988 |
| 6,088,648 | * | 7/2000 | Shah et al. | 701/117 |
| 6,133,853 | * | 10/2000 | Obradovich et al. | 340/905 |

* cited by examiner

*Primary Examiner*—Tan Nguyen
*Assistant Examiner*—Malena Tran
(74) *Attorney, Agent, or Firm*—Joseph P. Lally; J. Bruce Schelkopf

(57) ABSTRACT

A wireless network and an associated communication device are disclosed. The communication device is typically mounted in a first vehicle and includes a location device, such as a global positioning system receiver, suitable for determining the first vehicle's geographic position, a wireless transceiver enabled to communicate with a wireless transceiver of a second vehicle within a wireless range of the first vehicle, and a processor connected to the wireless transceiver and the location device. The processor is able to use the wireless transceiver and the location device to broadcast travel information of the first vehicle and to identify the presence of the second vehicle. The processor may also be enabled to display the position of the second vehicle on a display screen of the communication device or to enable the first vehicle to communicate with the second vehicle. The communication device may be configure to permit a user of the first vehicle, by clicking on an image of the second vehicle on the display screen, to obtain identification information of the second vehicle or to initiate a communication with the second vehicle. The communication with the traveler in the second vehicle may comprise a voice communication or an electronic message such as an email message. The first vehicle may include one or more environmental sensors connected to the processor that permit the communication device to broadcast weather information to other vehicle in the vicinity. The travel information exchanged among the vehicle may be organized into categories enabling the traveler to restrict information exchange based on one or more of the categories. The restriction criteria may include route criteria, transportation class criteria, and identity criteria.

18 Claims, 5 Drawing Sheets vehicle1,
timestamp
identity
location
roadway
direction
.
.
.
vehicle2,
timestamp
identity
location
roadway
direction
.
.
.
vehicleN,
timestamp
identity
location
roadway
direction
.
.
.

111

FIG. 5

HETEROGENEOUS WIRELESS NETWORK FOR TRAVELER INFORMATION

BACKGROUND

1. Field of the Present Invention

The present invention generally relates to field of wireless communication systems and more particularly to a network of traveling vehicles adapted to exchange network traveling information with each other.

2. History of Related Art

The increasing prevalence of electronic devices such as personal data administrators (PDAs), laptop computers, global positioning system, and wireless devices reflects the enormous demand for mobile data services. Despite this demand, however, an integrated solution enabling travelers to identify one another and exchange information relevant to travel itself is currently lacking. In the area of air travel for example, commercial airplanes currently lack an adequate method with which to identify and communicate with one another. Pilot reports and other important travel information are still largely generated manually and distributed through an intermediary such as an air traffic controller or flight service station on the ground. With respect to commercial trucking, the limitations of systems such as citizen band radios are readily apparent. Such systems provide only a limited ability for the driver of one vehicle to communicate with the driver of another vehicle that is in close proximity. Data transmission is not enabled with such a system and the ability to identify other travelers is limited to number of travelers that respond to a particular request. With respect to passenger automobile travel, the ability to identify readily and communicate with other drivers is virtually non-existent. While a cellular or PCS telephone can be used to communicate with selected travelers (i.e., the travelers whose mobile phone number is known), there is no present solution that enables one to determine easily the number and location of vehicles on the road. It would be desirable, therefore, to implement a network that facilitates the gathering and distribution of travel information to enable travelers of all types to determine the identify or existence of other travelers in their vicinity and to communicate with these travelers thereby resulting in more efficient, safe, and comfortable travel.

SUMMARY OF THE INVENTION

The problems identified above are in large part addressed by a wireless network and an associated communication device according to the present invention. The communication device is typically mounted in a first vehicle and includes a location device, such as a global positioning system receiver, suitable for determining the first vehicle's geographic position, a wireless transceiver enabled to communicate with a wireless transceiver of a second vehicle within a wireless range of the first vehicle, and a processor connected to the wireless transceiver and the location device. The processor is able to use the wireless transceiver and the location device to broadcast travel information of the first vehicle and to identify the presence of the second vehicle. The processor may also be enabled to display the position of the second vehicle on a display screen of the communication device or to enable the first vehicle to communicate with the second vehicle. The communication device may be configure to permit a user of the first vehicle, by clicking on an image of the second vehicle on the display screen, to obtain identification information of the second vehicle or to initiate a communication with the second vehicle. The communication with the traveler in the second vehicle may comprise a voice communication or an electronic message such as an email message. The first vehicle may include one or more environmental sensors connected to the processor that permit the communication device to broadcast weather information to other vehicle in the vicinity. The travel information exchanged among the vehicle may be organized into categories enabling the traveler to restrict information exchange based on one or more of the categories. The restriction criteria may include route criteria, transportation class criteria, and identity criteria.

BRIEF DESCRIPTION OF THE DRAWINGS

Other objects and advantages of the invention will become apparent upon reading the following detailed description and upon reference to the accompanying drawings in which:

FIG. 5 is a conceptual depiction of a router database for storing travel information according to the present invention.

Figure 1:
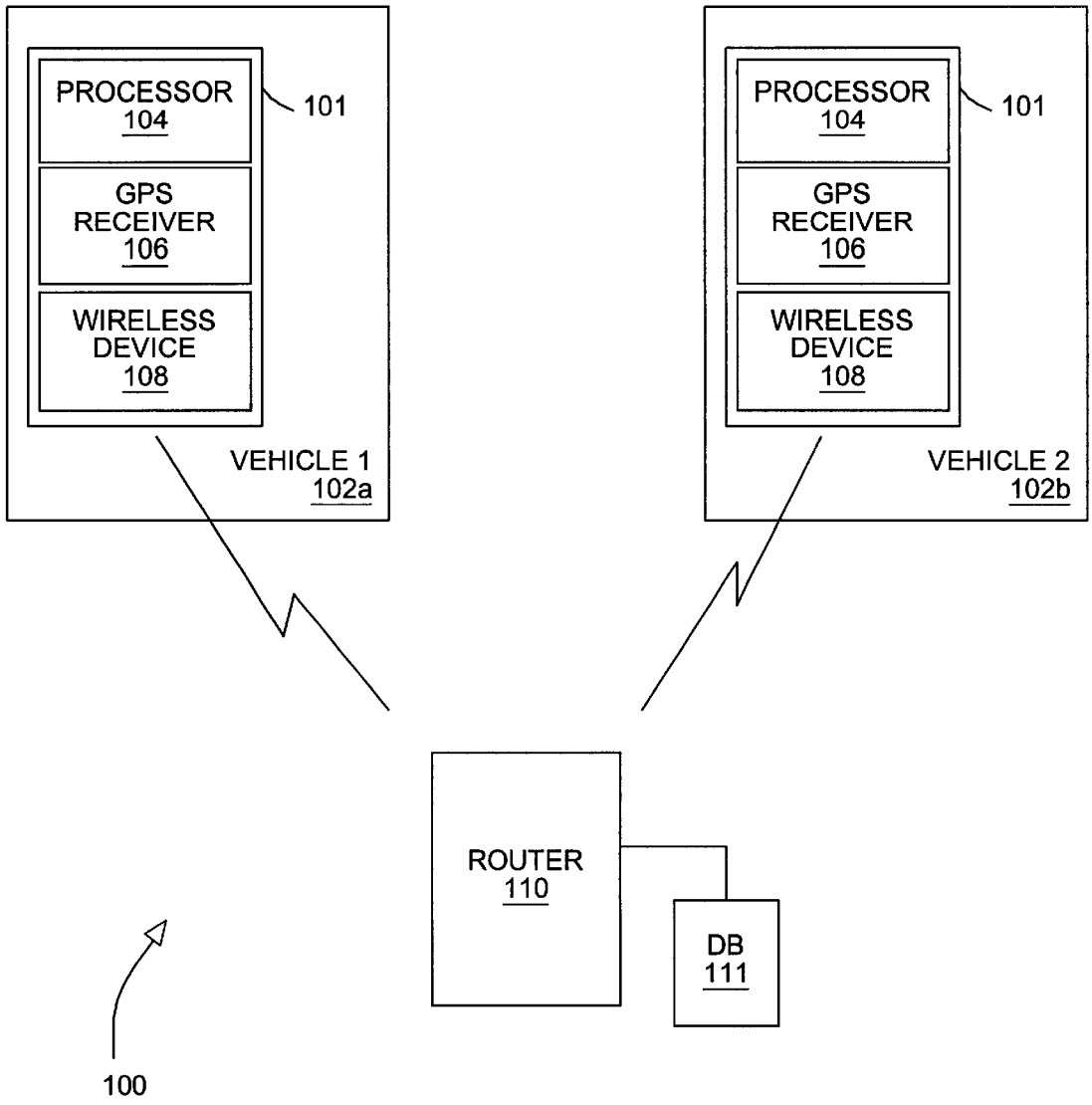
FIG. 1 is a block diagram of components of a wireless network for disseminating travel information according to one embodiment of the present invention.

While the invention is susceptible to various modifications and alternative forms, specific embodiments thereof are shown by way of example in the drawings and will herein be described in detail. It should be understood, however, that the drawings and detailed description presented herein are not intended to limit the invention to the particular embodiment disclosed, but on the contrary, the intention is to cover all modifications, equivalents, and alternatives falling within the spirit and scope of the present invention as defined by the appended claims.

DETAILED DESCRIPTION OF THE INVENTION

Turning now to the drawings, FIG. 1 depicts the basic elements of a network 100 that enables travelers to identify and communicate with other travelers within a limited proximity of each other. In the depicted embodiment, network 100 includes a first vehicle 102*a* and a second vehicle 102*b* (generically or collectively referred to herein as vehicle(s) 102). Each vehicle 102 is equipped with a communication device 101 that includes a processor 104, a location device 106, and a wireless transceiver 108. Processor 104 in conjunction with wireless transceiver 108 and location device 106, is enabled to identify the presence of other vehicles such as second vehicle 102*b* and to broadcast travel information to other vehicles 102 within range of first vehicle 102*a*.

The depicted embodiment of network 100 includes a router 110 configured to communicate via radio frequency or other suitable technology with wireless transceivers 108 within a limited range of router 110. Each router 110 gathers information from one or more vehicles 102 within its range and stores the information in a router database 111, which is local to its corresponding router. Router 110 is able to broadcast the information stored in database 111 to other vehicles 102. By utilizing the localized database 111, network 100 avoids overhead associated with maintaining all data in a centralized database. For example, routers 110 from different regions do not have to compete with each for access to a centralized database. Each router 110 maintains information on the vehicles within its wireless region. Typically, the information gathered and distributed by router 110 is travel information that enables travelers that are within proximity of each other to identify each other and exchange travel information. The travel information may indicate each traveler's identity, location, direction, speed, and vehicle class (i.e., automobile, ship, airplane, etc.). Referring to FIG. 5, a representation of database 111 is presented. In this representation, database 111 maintains a log of travel information for each vehicle 102 within its range. In the depicted embodiment, router 110 provides a datestamp for each vehicle to enable a data aging mechanism by which router 110 can discard information from database 111. As an example, router 110 may be enabled to discard information corresponding to a particular vehicle 102 if the router can affirmatively determine that the vehicle has left the vicinity of router 110 or when router 110 cannot verify the presence of a vehicle and the information in database 111 corresponding to the vehicle is older than a predetermined age limit.

Each vehicle 102 may be able to restrict selectively the type of information that it receives and transmits with router 110 thereby enabling each traveler to customize the information it exchanges with other vehicles 102.

Returning to FIG. 1, the communication devices 101 within a wireless range of router 110, together with router 110 itself, form a wireless network 100 enabling intercommunication among the travelers connected to the network. Each communication device 101 and router 110 may comply with a wireless protocol or wireless network technology that defines the physical and electrical characteristics of the system. Thus, network 100 may employ an internet (TCP/IP) type protocol supporting wireless IP-based access and information transfer, or a recognized wireless standard such as the IEEE 802.11 wireless LAN Standard, or other suitable wireless network technology. If network 100 is implemented with a particular standard or protocol that limits the range across which router 110 is permitted to transmit data, a particular geographic region may be serviced by multiple routers 110 that are physically located in relationship to each other to permit communication with a vehicle 102 traveling anywhere in the particular region. In this embodiment, the multiple routers corresponding to a particular region may share a common localized database 111. In contrast, another embodiment of network 100 may use a router 110, such as a satellite that is capable of monitoring vehicles over a wide range. In this embodiment, as discussed further below with respect to FIG. 3, a single router 110 may serve multiple geographic regions.

In one embodiment, location device 106 is implemented as a global positioning system (GPS) receiver configured to indicate its geographic position (location) and altitude. The GPS is a network of 24 satellites that orbit the Earth and make it possible for people with ground receivers to pinpoint their geographic location within approximately 100 to 10 meters. The GPS satellites orbit the Earth in precise orbits. The satellites are positioned such that at least four of the satellites are above the horizon any point on Earth at all times. Each GPS satellite includes a computer, an atomic clock, and a radio. Because the satellite orbits are well defined and the atomic clocks are extremely accurate, each satellite can continuously broadcast its changing position and time. Each GPS receiver on the ground contain a computer that "triangulates" its own position by getting bearings from three satellites typically within 100 meters. If a fourth satellite is "visible," the receiver can further determine altitude. Most modem GPS receivers are also able to calculate speed, direction of travel, and give estimated times of arrival to specified destinations. In addition, GPS receivers can typically store a receiver's track by periodically storing the receiver's position in its internal memory. The receiver can then display the path taken by the receiver.

Figure 4:
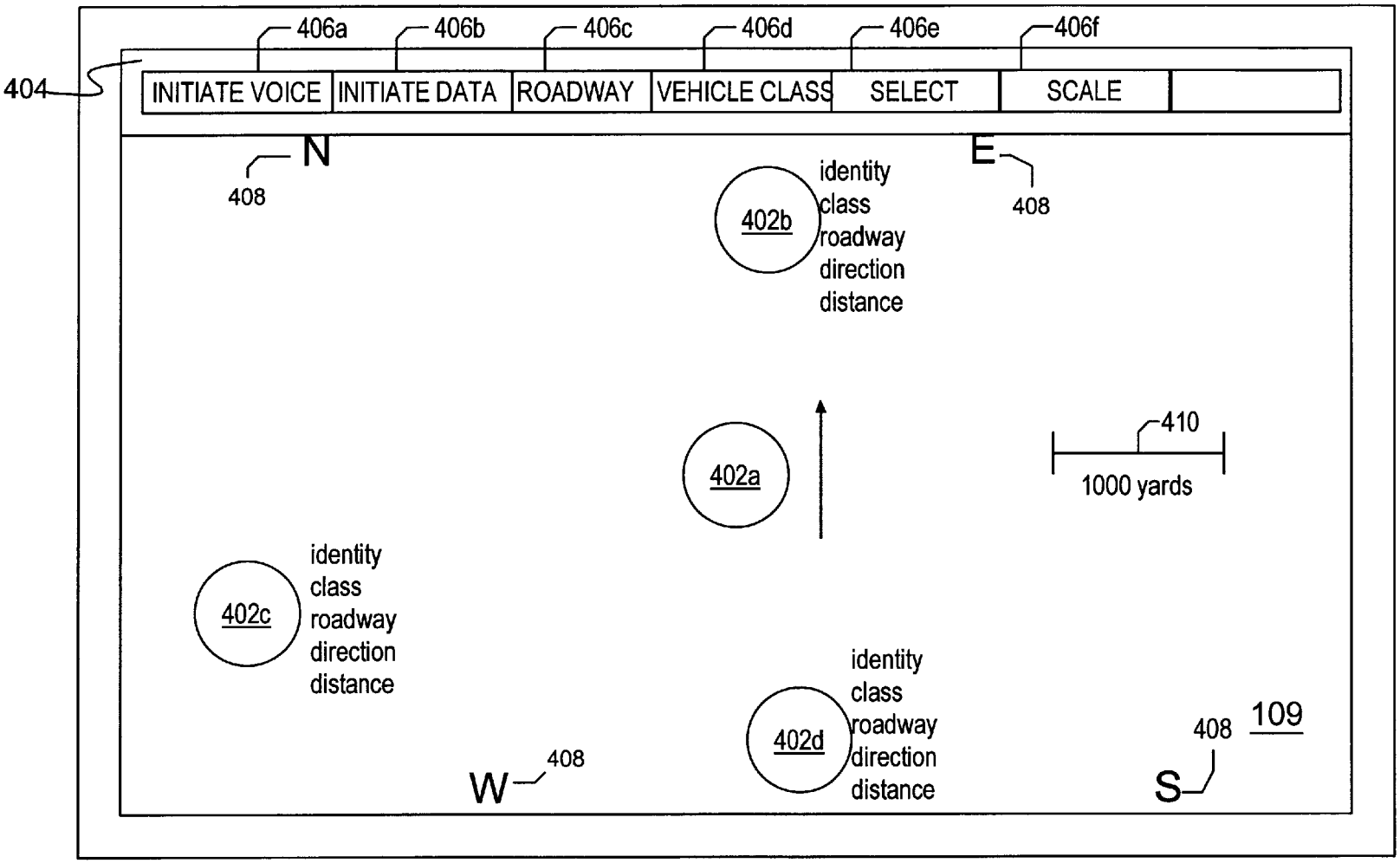
FIG. 4 is an illustrative of a display screen suitable for use in one embodiment of the invention.

In one embodiment, communication device 101 may include a display screen 109 to display graphical representations of travel information received from router 110. In one embodiment, for example, processor 104 is configured to display the location of other vehicles, such as second vehicle 102*b*, on display screen 109 relative to the position of first vehicle 102*a*. Referring to FIG. 4, a representation of an exemplary display screen 109 is presented. In this embodiment, the position of first vehicle 102*a* is represented by an icon 402*a* and is maintained at the center of display screen 109. The direction of travel of first vehicle 102*a* is indicated by the arrow adjacent to icon 402*a*. (Typically, this arrow is not present on the display screen and, by convention, the display screen is always oriented such that first vehicle 102*a* is moving towards the top edge of display screen 109). Icons 402*b*, 402*c*, and 402*d* (generically or collectively referred to as icon(s) 402) representing other vehicles within range of first vehicle 402*a* are displayed above, left of, and below the center to indicate vehicles that are (respectively) in front of, left of, and behind of first vehicle 102*a*. Display screen 109 may further indicate compass points 408, typically at the perimeter of display screen 109, to impart a fixed orientation to the display. In addition, an indication of scale, such as the variable length bar 410 of FIG. 4 that represents a fixed distance may be maintained on display screen 109.

Processor 104 may control display screen 109 with a graphical user interface that enables a traveler to interact directly with display screen 109. As an example, processor 104 of first vehicle 102*a* may be configured to obtain information about a second vehicle 102*b* by activating an icon representing second vehicle 102*b*. The information obtained in this manner may include identity information, vehicle class information, as well as location, direction of travel, and distance information. The identity information may include name of the vehicles owner, a license plate or vehicle ID number (VIN), a driver's license number or any other suitable identification information. The identification information may be used in an application of network 100 in which drivers of passenger and commercial vehicles are required to maintain an electronic registration while operating the vehicle. Such as system of registration is consistent with the concept of driving as a privilege granted by the state and would provide a wealth of useful information to law enforcement agencies. The depicted example of display screen 109 illustrates the display of such information for vehicles 102*b*, 102*c*, and 102*d* (represented by icons 402*b*, 402*c*, and 402*d* respectively). Communication device 101 and processor 104 may be further configured to enable a traveler in first vehicle 102*a* to initiate direct (point-to-point) communication with second vehicle 102*b*. In one embodiment, this facility may be invoked when a traveler in first vehicle 102*a* activates icon 402*b* on display screen 109 representing second vehicle 102*b*. The point-to-point communication may be a voice communication enabling a traveler in first vehicle 102*a* to speak with a traveler in second vehicle 102*b*. In this embodiment, first and second vehicles 102*a* and 102*b* may exchange frequency information (via router 110) thereby enabling direct communications between the two vehicles. A vehicle's current communication frequency could be displayed on the display screen 109 to facilitate this direct radio communication. In an embodiment in which network 100 is an IP-based network, the point-to-point communication may be in the form of a digital communication such as an email message. The various features of network 100 may be accessed via a command bar 404 of display screen 109. In the embodiment of display screen 109 depicted in FIG. 4, command bar includes a variety of command buttons 406*a* through 406*f* (command button(s) 406) dedicated for various features of network 100 including initiation of a voice communication (command button 406*a*), intimation of a data communication or email message (406*b*), initiation of a data exchange restriction based on roadway or route (406*c*), initiation of a data exchange restriction based on vehicle class 406*d*, initiation of a data exchange restriction to selected other vehicles 102*e*, and a change of scale feature (406*f*).

Figure 2:
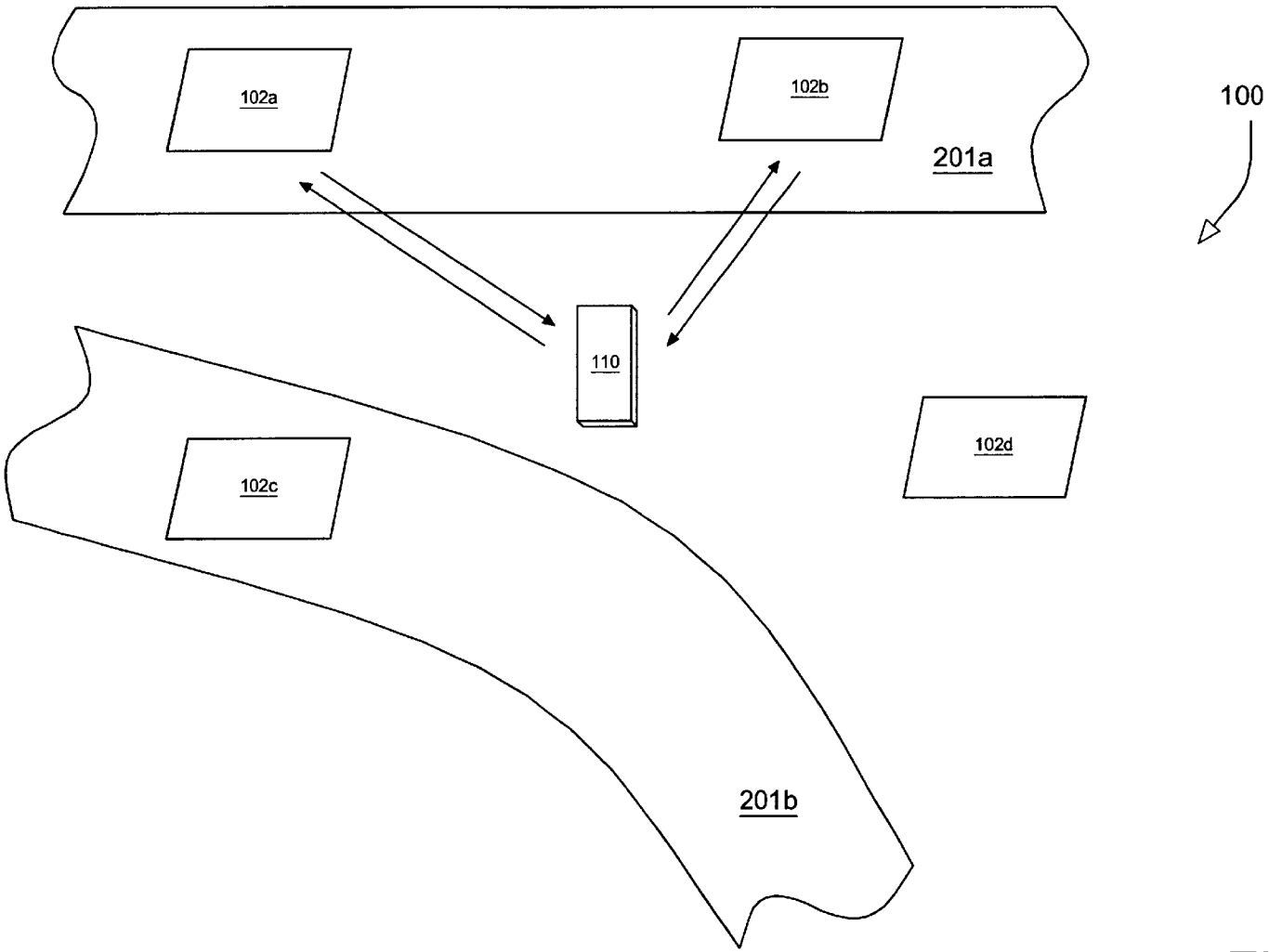
FIG. 2 is an illustration of the wireless network of the present invention implemented in a two dimensional application.

Turning now to FIG. 2, an illustration of an implementation of network 100 suitable for network travelers on the ground is presented. In FIG. 2, first and second vehicles 102*a* and 102*b* are depicted traveling on a first roadway 201*a*, a third vehicle 102*c* is depicted traveling on a second roadway 201*b*, and a fourth vehicle 102*d* is depicted without a corresponding roadway. In this embodiment, router 110 includes information about the geographic area serviced by router 110. More specifically, router 110 is able to correlate geographic locations within its range to certain features such as major roadways and landmarks. In such an embodiment, the information communicated or broadcast to each vehicle 102 in the vicinity of router 110 may include roadway information enabling vehicles 102*a* and 102*b* to determine that they were traveling along the same roadway. In one embodiment, the communication device 101 of each vehicle 102 may have a restriction feature enabling a vehicle to receive travel information from (or distribute travel information to) only selected other travelers. In embodiments in which roadway information is provided to each vehicle 102, a traveler may restrict information exchange to only those travelers on the same roadway. If first vehicle 102*a* restricted information exchange to travelers on the same roadway, for example, the display screen 109 of first vehicle 102*a* would indicate the presence of second vehicle 102*b* (which is on the same road 102*a* as first vehicle 102*a*), but would not indicate the presence of third vehicle 102*c* or fourth vehicle 102*d*. The correlation between geographic location and roadways contemplated in this embodiment might be suitably implemented with a look up table in router 110 that contained a series of geographic data points for each roadway. Using the look up table and suitable interpolation techniques, router 110 would be able to associate specific geographic locations received with specific roadways.

Vehicles 102 may be passenger automobiles, commercial land vehicles such as trucks or trains, boats or ships, as well as airplanes. Typically, the information provided to router 110 includes vehicle class information that enables a traveler to exchange information selectively with only those of the same class. In addition, each vehicle may belong to multiple vehicle classes. A passenger automobile might belong, for example, to a passenger automobile class as well as a broader class such as a land vehicle class thereby enabling each vehicle to customize the class of vehicles with which the traveler exchanges information. Regardless of the vehicle class, network 100 and communication devices 101 enable travelers to identify other travelers within their immediate vicinity (i.e., within their wireless range) and to exchange precise location and direction information. Information stored in routers 110 may be updated on a real time basis to provide changing navigation information. With respect to land travelers, for example, routers 110 may be periodically updated with road construction information, traffic jam information, and other information indicating less than favorable traveling conditions. With respect to boats and ships, router 110 may contain navigation instructions that would enable boats and ships to traverse dangerous channels and obstacles.

In the case of car and trucks, network 100, in addition to enabling vehicles 102 to identify each other within their vicinity and to exchange precise location and direction information, might include various other features such as emergency vehicle identification, accident witness logs, and driver registration features. In one embodiment, router 110 is enabled to identify emergency vehicles such as ambulances and fire vehicles and broadcast the presence of these vehicles to traveler vehicles 102. Upon detecting emergency vehicle information from router 110, processor 104 could display the presence of an approaching emergency vehicle on display screen 109 with a distinctive icon or other symbol that readily identifies the vehicle as an emergency vehicle. In one embodiment, for example, emergency vehicles are displayed on display screen 109 in a unique color such as red that rapidly conveys emergency vehicle status to the driver of vehicle 102*a*. Another feature especially suited for automobiles and trucks is the vehicle witness log feature, which generates a list or log of all vehicles within a specified range of the requesting vehicle's range upon request. As its name implies, the vehicle witness log feature might beneficially enable a vehicle to generate a list of vehicles that were in the immediate vicinity of an accident or other notable event. Using this feature of communication device 101 and network 100, a traveler could rapidly generate a detailed log of vehicles in the vicinity following an accident. The log could include vehicle identification, location, and direction information as well as time of day information. Such a log could be stored in a non-volatile memory portion (not explicitly depicted) of processor 104 for subsequent retrieval. In one embodiment, the vehicle witness log could be initiated by traveler request by selecting from an appropriate icon or menu on display screen 109. In another embodiment, the vehicle witness log could be initiated automatically upon detecting a specified occurrence. As an example, the activation of supplemental restraints (airbags) could automatically trigger a request for a vehicle log.

Figure 3:
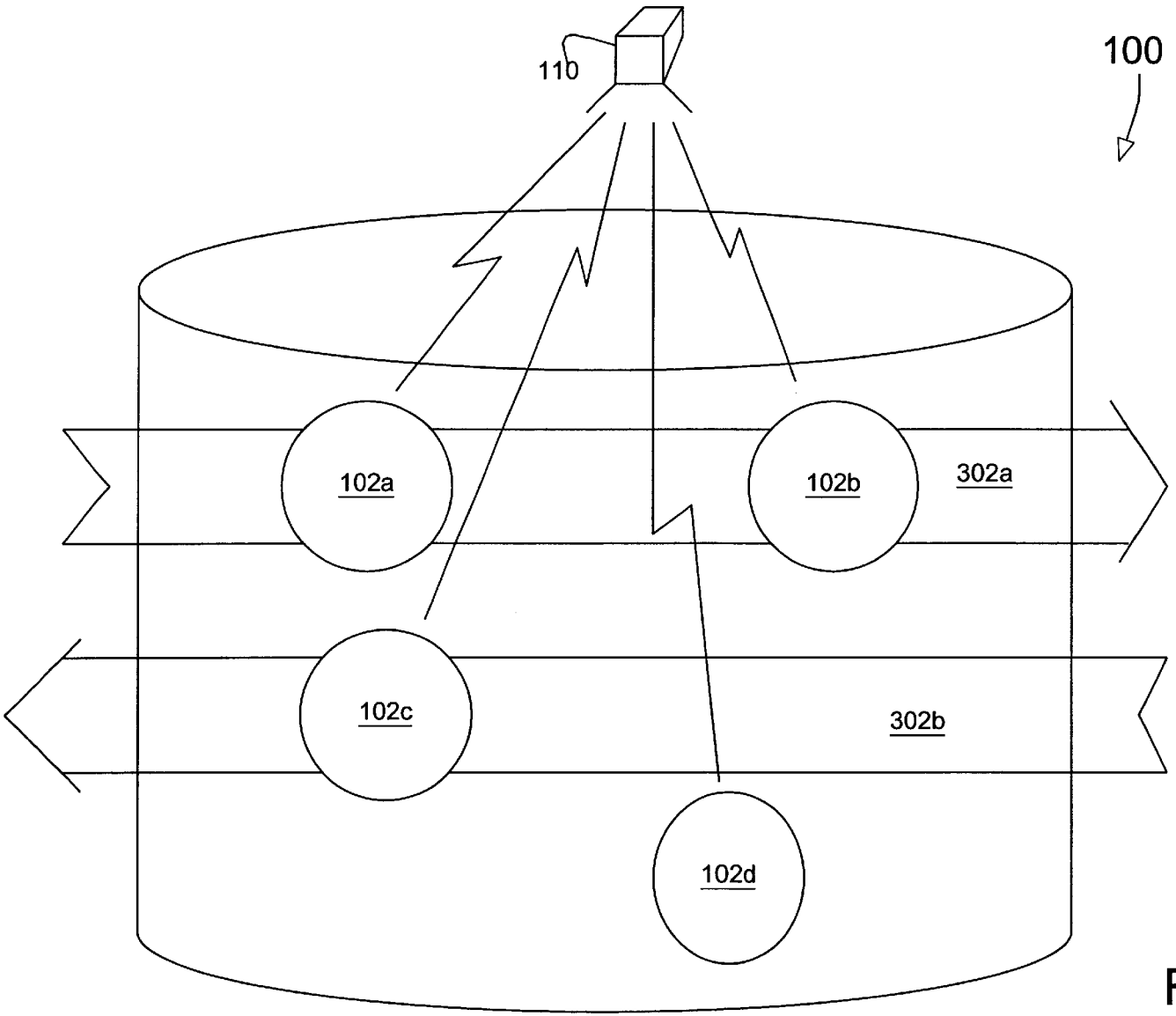
FIG. 3 illustrates an example of the wireless network of the present invention implemented in a three dimensional application.

Turning now to FIG. 3, an illustration of a network 100 optimized for an air travel application is depicted. In this embodiment, each vehicle 102 represents an airplane or other flying vehicle. First vehicle 102*a* and second vehicle 102*b* are shown in a first vector airway 302*a* while a third vehicle 102*c* is shown in a second vector airway 302*b* and a fourth vehicle 104*d* is shown as not within a specified airway. In this embodiment, network 100 contemplates a mechanism by which air vehicles could manage their own air space without regard to their proximity to air traffic control or flight service station facilities. Using their communication devices 101 and a suitable router 110, each plane could identify and communicate with other planes within its immediate air space. Because conventional base station type routers suitable for use in land based applications of network 100 do not operate at altitudes significantly above the altitude of the base station itself, the routers 110 of the embodiment of network 100 depicted in FIG. 3 would be implemented with satellite technology. Similar to the routers 110 depicted in FIG. 1 and FIG. 2, the satellite router 110 of FIG. 3 would typically include a localized database (not depicted) where the satellite maintains the vehicle information necessary to implement network 100. Depending on the capabilities of the satellite, a single satellite router could handle multiple geographic regions. In such an embodiment, the satellite router database would typically be parsed in sub-databases corresponding to each geographic region. Preferably, the database or databases corresponding to each satellite router would including vector airway information that would enable router 110 to correlate geographic positions and altitudes with corresponding vector airways. In this embodiment, each vehicle 102 may include facilities for restricting the travel information it receives from router 110 to information for other vehicles 102 within the same vector airway 302. In an embodiment in which the flying vehicles 102 of FIG. 3 include on-board computers and environmental sensors, processor 104 may be configured to assemble periodic pilot reports (PIREPS) and transmit the PIREPS to satellite router 110. Satellite router 110 could the broadcast these PIREPS to other vehicles 102 flying the same vector airway 302. In this manner, network 100 would enable the widespread and automatic distribution of flight information on a real time basis to improve the comfort and safety of the flight.

It will be apparent to those skilled in the art having the benefit of this disclosure that the present invention contemplates a wireless network for exchanging travel related information. It is understood that the form of the invention shown and described in the detailed description and the drawings are to be taken merely as presently preferred examples. It is intended that the following claims be interpreted broadly to embrace all the variations of the preferred embodiments disclosed.

What is claimed is:

1. A communication device for use in a first vehicle, comprising:

a location device suitable for determining the first vehicle's geographic position;

a wireless transceiver enabled to communicate with a wireless transceiver of a second vehicle within a wireless range of the first vehicle;

a processor connected to the wireless transceiver and the location device and enabled to broadcast travel information of the first vehicle and detect the presence of the second vehicle and display an image indicating the position of the second vehicle on a display screen of the communication device and further configured to enable a user of the first vehicle, by clicking on the image of the second vehicle, to initiate communication with a user of the second vehicle.

2. The communication device of claim 1, wherein the location device comprises a global positioning system receiver.

3. The communication device of claim 1, wherein the location of the second vehicle is displayed on the display screen relative to the position of the first vehicle.

4. The communication device of claim 3 further configured to enable a user of the first vehicle, by clicking on the image of the second vehicle to obtain identity information of the second vehicle.

5. The communication device of claim 4 wherein the identity information includes an electronic registration of the second vehicle.

6. The communication device of claim 1, wherein the communication with the user of the second vehicle comprises voice communication.

7. The communication device of claim 1, wherein the communication with the user of the second vehicle comprises email communication.

8. The communication device of claim 1, wherein the first vehicle includes at least one environmental sensor connected to the processor for gathering weather information and further wherein the communication device is enabled broadcast the weather information to the second vehicle.

9. A communication device, for use in a first vehicle, comprising:

a location device suitable for determining the first vehicle's geographic position;

a wireless transceiver enabled to communicate with a wireless transceiver of a second vehicle within a wireless range of the first vehicle;

a processor connected to the wireless transceiver and the location device and enabled to broadcast travel information of the first vehicle and to detect the presence of the second vehicle and further enabled to display the position of the second vehicle on a display screen of the communication device and enable the first vehicle to communicate with the second vehicle if the second vehicle satisfies user selectable restriction criteria.

10. The communication device of claim 9, wherein the restriction criteria include route criteria, transportation class criteria, and identity criteria.

11. A network for communicating travel information, comprising:

a plurality of communication devices, each located within a corresponding vehicle, wherein each communication device includes a processor coupled to a wireless transceiver, a global positioning system receiver, and a display screen; and a router suitable for communicating with the wireless transceivers in each communication device within range of the router; wherein the communication devices are enabled to broadcast location information to the router and the router is enabled to distribute the location information to each of the plurality of vehicles and wherein each vehicle is enabled to receive the location information and, based thereon, to display images on its display screen indicating the relative locations of each vehicle and further wherein each communication device is enabled to initiate communication with a selected other vehicle if a traveler activates the other vehicle's image on the display screen.

12. The network of claim 11, wherein the processor of each vehicle is enabled to display identity information of the selected other vehicle.

13. The network of claim 12, wherein the identity information includes an electronic registration of the selected other vehicle.

14. The network of claim 11, wherein the communication with the selected other vehicle comprises voice communication.

15. The network of claim 11, wherein the communication with the user of the second vehicle comprises email communication.

16. The network of claim 11, wherein the first vehicle includes at least one environmental sensor connected to the processor for gathering weather information and further wherein the communication device is enabled broadcast the weather information to the other vehicles.

17. A network for communication travel information comprising:

a plurality of communication devices, each located within a corresponding vehicle, wherein each communication device includes a processor coupled to a wireless transceiver, a global positioning system receiver, and a display screen; and a router suitable for communicating with the wireless transceivers in each communication device within range of the router; wherein the communication devices are enabled to broadcast location information to the router and the router is enabled to distribute the location information to each of the plurality of vehicles and wherein each vehicle is enabled to display images of the other vehicles on the display screen indicating their corresponding locations and further wherein the communication device is enabled to prevent display of a vehicle based on at least one restriction criteria.

18. The network of claim 17, wherein the restriction criteria include route criteria, transportation class criteria, and identity criteria.

* * * * *